United States Patent [19]

Gulliver

[11] Patent Number: 4,630,867

[45] Date of Patent: Dec. 23, 1986

[54] ELECTROSTATIC DISSIPATIVE CHAIR

[75] Inventor: Barron J. Gulliver, Sturgis, Mich.

[73] Assignee: Harter Corporation, Sturgis, Mich.

[21] Appl. No.: 714,006

[22] Filed: Mar. 20, 1985

[51] Int. Cl.[4] ..... A47C 7/02

[52] U.S. Cl. ..... 297/452; 361/212; 297/219

[58] Field of Search ..... 297/452, 217, 219; 361/212

[56] References Cited

U.S. PATENT DOCUMENTS

| | | | |
|---|---|---|---|
| 1,744,004 | 1/1930 | Hunt | 297/217 X |
| 2,731,542 | 1/1956 | Daniels | 297/217 X |
| 2,802,148 | 8/1957 | Allder | 297/217 X |
| 2,858,482 | 10/1958 | Nutter | 297/217 X |
| 3,003,816 | 10/1961 | Wilson | 297/219 |
| 3,288,175 | 11/1966 | Valko | 361/212 X |
| 4,208,696 | 6/1980 | Lindsay et al. | 361/212 |
| 4,475,768 | 10/1984 | Webb | 297/219 |
| 4,494,165 | 1/1985 | Maheshwari | 361/212 X |
| 4,513,347 | 4/1985 | Wilcox et al. | 361/212 |

OTHER PUBLICATIONS

Evaluation Engineering, Oct. 1983, p. 110—advertisement for Adjusto Equipment Company.

*Primary Examiner*—Francis K. Zugel

*Attorney, Agent, or Firm*—Renner, Kenner, Greive, Bobak & Taylor

[57] ABSTRACT

A seating device (10) capable of dissipating an electrostatic charge received thereby, the seating device (10) having a frame (11) defining an electrical ground. A rigid supportive substrate (24) is fixedly secured to the frame (11). A cushion (32) is carried by the supportive substrate (24) and an electrically conductive mesh (33) is carried over the cushion (32) and secured to the supportive substrate (24). An electrically nonconductive cover (40) is carried over the mesh (33) and is, likewise, secured to the supportive substrate (24). Means (42) are provided to electrically communicate the mesh (33) with the frame (11).

10 Claims, 5 Drawing Figures

ELECTROSTATIC DISSIPATIVE CHAIR

TECHNICAL FIELD

The present invention relates generally to office and workplace chairs. More particularly, the present invention relates to chairs suitable for conducting and dissipating electrostatic charges from a person. Specifically, the present invention relates to a chair in which an electrically conductive medium is positioned under a nonconductive protective covering such that electrostatic charges may be conducted away from the user and subsequently dissipated. To elaborate on the conductive aspect of the invention, an electrically conductive medium is disposed immediately under, and adjacent to, the electrically nonconductive protective covering of the chair. The electrically conductive medium is electrically associated with an electrical ground having substantially zero electrical potential such that any electrostatic charge received from the user may be conducted to, and dissipated by, the ground.

BACKGROUND ART

It is quite common, under various atmospheric conditions, for a person to accumulate a considerable electrostatic charge on or about their body. Indeed, it is not uncommon for such a charge to reach a potential of several thousand volts, albeit at very low current. Normally, this electrostatic charge is dissipated from the person whenever they come into contact with a conductive ground potential medium, such as a metal structure. Depending upon the conductivity of the ground potential medium and the atmospheric conditions, such dissipation of the electrostatic charge can be quite rapid and in the form of a substantially instantaneous electric spark.

While such sparking is generally of little significance, under some circumstances it may prove relatively dangerous to the person and/or the surroundings. For example, it is undesirable to have electrostatic sparking in oxygen rich atmospheres, as may be found in hospital operating rooms. Likewise, it is dangerous to have sparking in potentially combustible atmospheres, as for example hydrogen enriched atmospheres or near natural gas systems. Furthermore, it is undesirable to have sparking occur when working with sensitive electronic equipment such as in the production of electronic integrated circuits or when working with computer and data recording apparatus.

As a result of these crucial situations, several courses of action have been taken to prevent or control electrostatic sparks. One technique is to control the atmospheric conditions in which the person is working. By maintaining a fairly high relative humidity, electrostatic charges are less likely to accumulate on a person. However, it is not always feasible or economical to maintain such stringent control over atmospheric conditions.

Another approach to reducing electrostatic sparks is to employ electrically conductive pads and floor mats on which the person will be working. Such pads and floor mats conduct electrical charges away from the person and dissipate the same to an electrical ground, such as a grounded receptacle.

A similar technique is to employ chairs, work tables and other furniture with electrically conductive fabrics to conduct and dissipate electrostatic charges from the user. Such furniture may be used in conjunction with the aforesaid conductive pads and floor mats or individually, as the case may warrant.

An inherent problem with the foregoing pads, floor mats and furniture is the substantial cost and limited selection of electrically conductive fabrics available. Particularly, the less expensive fabrics are generally carbon-impregnated materials. As such, they are generally limited to very dark or black colors. Other fabrics employ wire or other forms of metallization woven into the fabric during manufacture thereof. Such special weaving processes, however, substantially increase the cost of the fabric.

With the current trend toward office automation, many people are in need of furniture, for use with their electronic computers and similar equipment, that will arrest and dissipate electrostatic charges on the user. However, because they are used in an office environment, it is highly desirable that the office furniture also compliment the office decor. Accordingly, users are in need of furniture that is both inexpensive and available in a wide variety of styles and colors. Moreover, manufacturers of such furniture must be able to supply such variety without the inherent cost incurred with an inventory of different, and expensive, electrostatically conductive fabrics produced in accordance with prior art techniques.

DISCLOSURE OF THE INVENTION

It is, therefore, a primary object of the present invention to provide a chair suitable for conducting and dissipating electrostatic charges from a person.

It is another object of the present invention to provide a chair, as above, that can employ fabric material in a wide variety of colors and styles.

It is yet another object of the present invention to provide a chair, as above, that is relatively inexpensive to produce and does not require the manufacturer to maintain a large inventory of costly electrostatically conductive fabrics.

These and other objects of the invention, as well as the advantages thereof over existing and prior art, which will be apparent in view of the following specification, are accomplished by means hereinafter described and claimed.

In general, a seating device capable of dissipating an electrostatic charge received thereby according to the concept of the present invention, includes a supportive substrate and an electrically conductive medium. The electrically conductive medium is carried over the supportive substrate and secured thereto and is suitable for receiving an electrostatic charge. An electrically nonconductive cover is carried over the electrically conductive medium and is, likewise, secured to the supportive substrate. Means are provided to electrically communicate the medium with an electrical ground so as to absorb and dissipate an electrostatic charge.

EXEMPLARY EMBODIMENT FOR CARRYING OUT THE INVENTION

Figure 1:
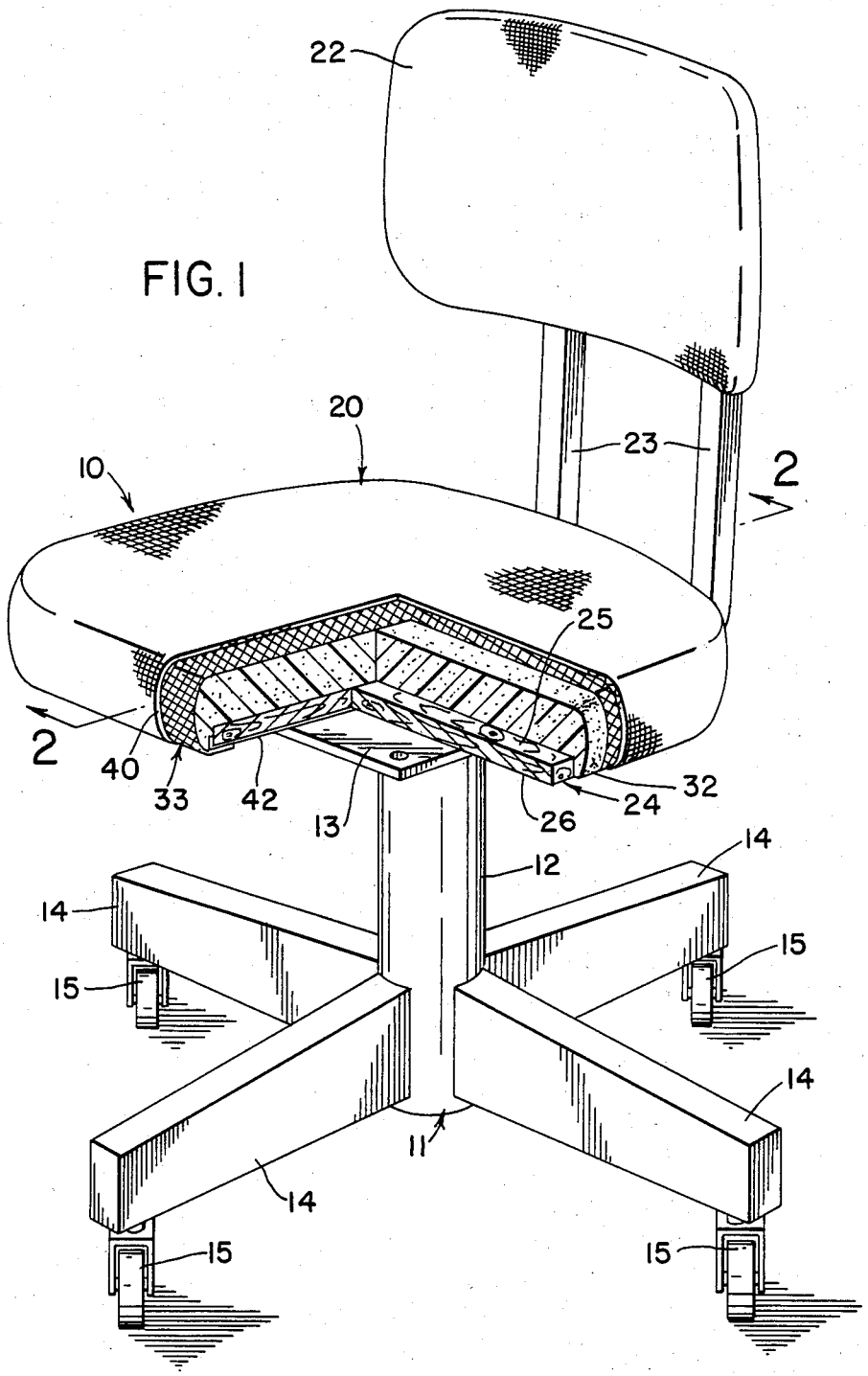
FIG. 1 is a perspective view, partially in section, of a chair embodying the concept of the present invention.

A chair suitable for conducting and dissipating electrostatic charges from a person, according to the concept of the present invention, is indicated generally by the numeral 10 in FIG. 1 of the attached drawings. The chair 10 includes a metal frame 11 having a vertical post 12, on the top of which is fixedly secured a planar support base 13. A plurality of radially disposed legs 14 extend outwardly from the lower end of vertical post 12; each leg 14 carrying a swivel caster assembly 15 to permit free, two-dimensional motion of the chair 10 over a floor surface.

A seat 20 is removably secured to support base 13 by a plurality of mounting bolts 21. A back rest 22, likewise, is suitably secured to a metal back support 23, which in turn is secured to support base 13, as by welding. Inasmuch as the construction of seat 20 is substantially identical to that of back rest 22, specific discussion will be directed to seat 20, it being understood that such discussion is equally applicable to back rest 22, unless otherwise indicated.

Figure 2:
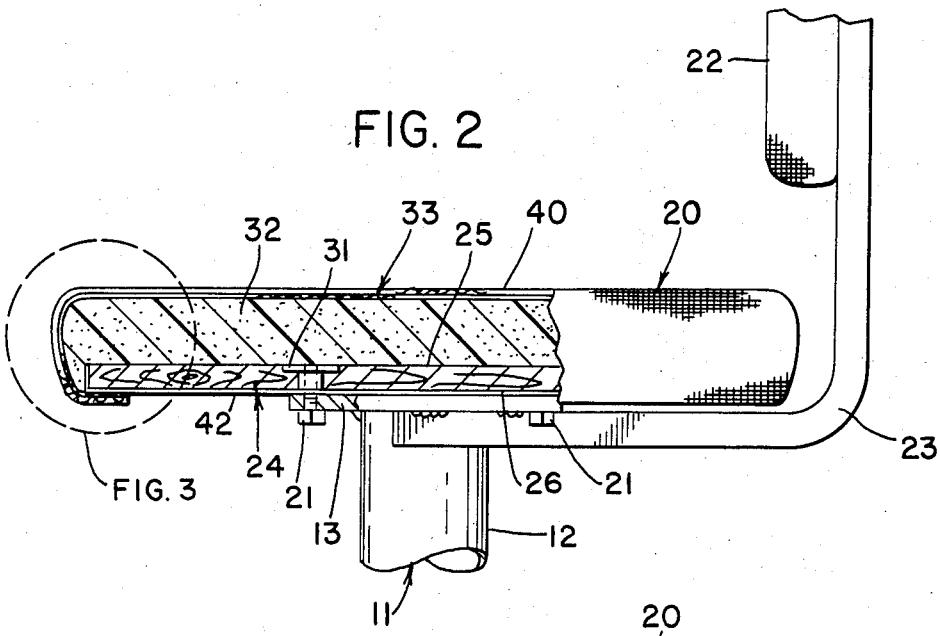
FIG. 2 is an enlarged fragmentary cross-section taken substantially along line 2—2 of FIG. 1.
Figure 3:
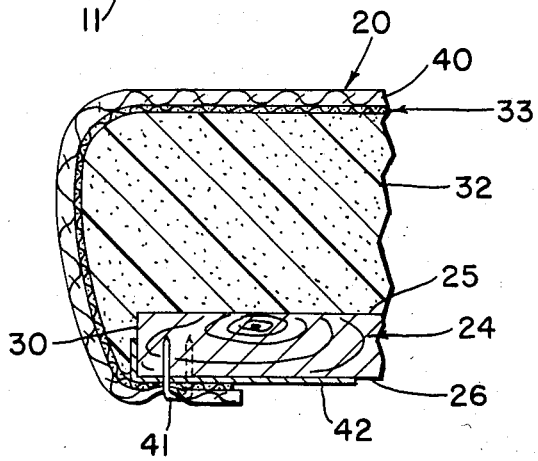
FIG. 3 is an enlarged fragmentary cross-section of the chair depicted in FIG. 1, showing the construction thereof in greater detail.

The specific structure of seat 20 is more clearly depicted in FIGS. 2 and 3. Particularly, seat 20 employs a supportive substrate 24 which defines, essentially, the planar configuration of seat 20. Supportive substrate 24 is, itself, a substantially rigid planar element having an upper surface 25 and a lower surface 26. The plan configuration of supportive substrate 24, and ultimately of seat 20 itself, is defined by the periphery 30 of supportive substrate 24. It should be appreciated that while supportive substrate 24 is shown as having a relatively rectangular, planar cross-section, other configurations are contemplated and may depend upon the material from which supportive substrate 24 is made and the manner in which it is mounted to frame 11.

Supportive substrate 24 is secured to support base 13 with mounting bolts 21. Each mounting bolt 21 passes through supportive substrate 24 and threadably engages a retaining nut 31, which may be carried by upper surface 25 of supportive substrate 25. As depicted in FIG. 2, it is preferred that supporting nut 31 be at least partially embedded in supportive substrate 24 so as not to interfere with the comfort aspect of seat 20, as will be more fully appreciated from the following description.

A cushion 32 is carried by upper surface 25 of supportive substrate 24 and extends over the periphery 30 thereof, to provide comfortable support. Cushion 32 is commonly an electrically nonconductive cellular, resilient foam, such as a polyurethane foam or the like, which provides approximately one to four inches (2.54 cm to 10.16 cm) of flexible support over supportive substrate 24. It is likewise preferable to bond cushion 32 to upper surface 25 and periphery 30 of supportive substrate 24 so as to avoid slippage and bunching of cushion 32 relative thereto, as would be appreciated by one skilled in the art.

A conductive mesh 33 is carried over the exposed surface of cushion 32 as the latter is bonded to supportive substrate 24. Conductive mesh 33 extends downwardly about periphery 30 of supportive sustrate 24 and is suitable to be secured about the lower surface 26 thereof. Accordingly, conductive mesh 33 defines an electrically conductve medium for receiving an electrostatic charge.

For purposes of the present disclosure, conductive mesh 33 is deemed to be electrically conductive when it has a surface resistivity of approximately $10^5$ ohms per square, or less, when tested in accordance with ANSI/ASTM D257 standards, as established by the American National Standard Institute, American Society for Testing and Materials. Furthermore, it is preferred that the surface resistivity of conductive mesh 33 be on the order of approximately $10^2$ ohms per square, or less.

Figure 4:
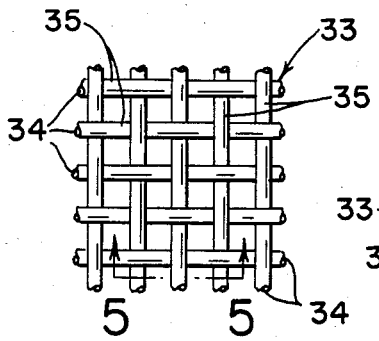
FIG. 4 is an enlarged fragmentary plan view of the conductive mesh as employed by the chair depicted in FIG. 1; and, FIG. 5 is an enlarged fragmentary cross-section taken substantially along line 5—5 of FIG. 4.
Figure 5:
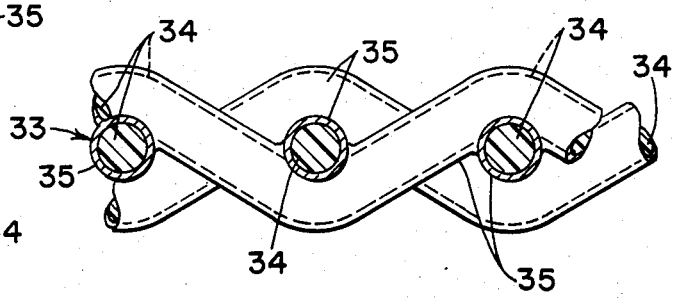

With reference to FIG. 4 and FIG. 5, the specific structure of conductive mesh 33 can be considered. Particularly, conductive mesh 33 represents an open weave electrically conductive fabric of relatively fine strands 34, approximately 0.008 inch (0.02 mm) in diameter, preferably of a nonconductive synthetic fiber, such as nylon for example. Such a construction provides a thin, light-weight material having good flexibility and desirable strength-to-weight characteristics, as well as good wear characteristics, as will be appreciated herebelow.

The strands 34 of conductive mesh 33 carry a highly electrically conductive coating 35, such as a silver plating for example. Such coating 35 defines the electrically conductive medium for mesh 33 as a whole. It should be noted that while strands 34 may receive coating 35 prior to weaving of mesh 33, it may be more desirable to apply coating 35 to mesh 33 subsequent to the weaving process. This latter procedure assures a continuous coating 35 to exist over essentially the entire area of mesh 33 without the risk of removal of coating 35 from the individual strands 34 during the weaving process.

It should be appreciated that the particular weave pattern of conductive mesh 33 depicted in FIG. 4 and FIG. 5 is merely an exemplary configuration. Indeed conductive mesh 33 may assume a wide variety of weave patterns and, yet, remain within the concept of the present invention. Moreover, strands 34 may be of a conductive wire, such as copper, as opposed to a nonconductive fiber. Such an assembly may, therefore, eliminate the need for conductive coating 35 while retaining the overall conductive nature of mesh 33.

As depicted in FIG. 3, conductive mesh 33 preferably is secured to supportive substrate 24 along the outer, peripheral edge of lower surface 26. Conductive mesh 33 need not be bonded, or otherwise physically secured, to cushion 32, but rather may be physically independent therefrom and able to move freely relative thereto. Such a configuration permits both cushion 32 and conductive mesh 33 to yield independently under a load applied to the chair 10 without attendant stresses being imposed on or by the juxtaposed material.

In similar manner, an electrically nonconductive cover fabric 40 is carried over conductive mesh 33 and is, likewise, secured to the lower surface 26 of supportive substrate 24. Cover fabric 40, accordingly, defines an electrically nonconductive medium. It should be noted that for purposes of the present disclosure, cover fabric 40 is deemed to be electrically nonconductive when it has a surface resistivity of approximately $10^{10}$ ohms per square, or greater, when tested in accordance with ANSI/ASTM D257 standards.

Cover fabric 40 is preferably a woven fabric of a fiber type suitably employed as a covering material for a chair or the like. Although acceptable, and while being in direct physical contact with conductive mesh 33, cover fabric 40 need not be physically secured thereto, other than perhaps in the region where both are secured to supportive substrate 24. Accordingly, cover fabric 40 preferably can move freely relative to conductive mesh 33, again permitting each to yield independently under a load without inducing stresses into the other.

With respect to securement of conductive mesh 33 and cover fabric 40 to supportive substrate 24, it should be recognized that each may be secured thereto independently or together. Moreover, such securement can be achieved through a variety of manners, such as by adhesive bonding or, as depicted in FIG. 3, through use of staples 41 or tacks. Indeed, in the preferred embodiment depicted in the drawings, both conductive mesh 33 and cover fabric 40 are secured simultaneously to supportive substrate 24 via staples 41.

A conductive strip 42 extends radially along the lower surface 26 of supportive substrate 24 from the periphery 30 to a point within the mounting region of support base 13, as depicted in FIG. 2. Conductor strip 42 is preferably a thin adhesive-backed aluminum tape, or similar conductive material, approximately 0.005 inch (0.127 mm) thick by 1 inch (2.54 cm) wide, suitable for defining an electrically conductive path from conductive mesh 33 to frame 11. Accordingly, it should be appreciated that one end of conductor strip 42 is in electrical communication with conductive mesh 33 and the other end of conductor strip 42 is in electrical communication with support base 13 when conductive mesh 33 and support base 13 are each secured to supportive substrate 24. Furthermore, as depicted in FIG. 3, it is preferable to extend conductor strip 42 at least a portion of the way up the periphery 30 of supportive substrate 24 so as to assure an area of contact with conductive mesh 33. Likewise, it is preferable to extend conductor strip 42 into a a region through which a mounting bolt 21 passes so as to effect sufficient clamping force on conductor strip 42 by support base 13 and supportive substrate 24 and, accordingly, assure an electrical interconnection with frame 11.

It should be recognized that conductor strip 42 generally is required whenever supportive substrate 24 is not, itself, made of a conductive material, as in the situation where it is made of a plywood material. Indeed, an electrically conductive path with frame 11 is defined by supportive substrate 24 when the latter is made of a metal, such as steel or aluminum, thereby obviating the need for conductor strip 42.

The advantages of the disclosed chair 10 may be better appreciated by considering the functioning thereof in arresting electrostatic charges from a person. Specifically, whenever a person sits on, or otherwise comes in contact with, the seat 20 and/or back rest 22 of the chair 10, electrostatic charges on the person are conducted to, and received by, conductive mesh 33. Similarly, while the person is seated in the chair 10, electrostatic charges are continually conducted to, and dissipated by, conductive mesh 33. This occurs even though the person never comes into direct contact with conductive mesh 33 but is separated therefrom by cover fabric 40, which itself is nonconductive.

The ability of conductive mesh 33 to conduct electrostatic charges from the person even though physically displaced therefrom is a combined feature of the high conductivity of conductive mesh 33 and the ability of the electrostatic charge to jump across an air gap. Indeed, with the relative thickness of cover fabric 40 being approximately 0.05 inch (0.12 cm) electrostatic charges on the person can readily "jump" to conductive mesh 33. Moreover, because of the large surface area of conductivity, essentially the entire surface area of the seat 20 and/or back rest 22, the flow of the electrostatic charge from the person to the chair 10 is at a very low current density.

The construction of the chair 10 also provides a safety feature not generally associated with the prior art. Specifically, nonconductive cover fabric 40 acts as an insulator to dangerously large electrical currents, approximately 10 amperes or greater, associated with lower line voltages, approximately 110 volts, normally employed with electrical equipment. Indeed, such lower voltage electricity will not readily "jump" to conductive mesh 33 so that a dangerous electrical circuit is not completed through the body of the person. Therefore, the person working with electrical equipment will not experience a greater risk of electrical shock when seated in the seat 10 as opposed to using some prior art electrostatic dissipative equipment.

Upon being received by conductive mesh 33, the electrostatic charge is carried along conductor strip 42 to frame 11. This is a result of the electrical, interconnections between conductive mesh 33 and conductor strip 42 and, respectively, between conductor strip 42 and support base 13. It has been found that the mass of frame 11, alone, is sufficient to absorb and dissipate the electrostatic charges received by conductive mesh 33 thereby acting as an electrical ground. However, should conditions exist wherein substantial electrostatic charges are present or where increased dissipation of such charges is required, frame 11 may be electrically communicated with a further electrical ground. As would be appreciated by one skilled in the art, a wiper extending from frame 11 and contacting the floor, or a conductor lead interconnected between frame 11 and a grounded terminal, may be employed with the disclosed chair 10 to further dissipate electrostatic charges received thereby. It has also been found that, in many instances, sufficient electrical communication with the floor is achieved via conductive caster assemblies 15. Indeed, practically any existing remedies for dissipating electrostatic charges may be employed in conjunction with chair 10 with correspondingly improved results as attributable to the operation of the chair 10.

It should be appreciated that a chair 10 made in accordance with the foregoing disclosure provides significant advantages over known apparatus. Specifically, by employing a fine, electrically conductive mesh 33 under cover fabric 40, the chair 10 is readily capable of receiving electrostatic charges from a person. Furthermore, because conductive mesh 33 is distinct from the nonconductive cover fabric 40, the latter may be selected from a wide variety of materials, thereby permitting the chair 10 to aesthetically match and compliment other furniture in the office environment where used, including chairs that are not electrostatically conductive. In addition, the cover fabric 40 may be removed, for cleaning or replacement, as required without disrupting the conductive characteristics of the chair 10, and with less overall cost. Moreover, when the chair 10 is constructed with the cushion 32, conductive mesh 33 and cover fabric 40 each capable of freely moving relative to each other, the end result is an assembly which is highly flexible and comfortable. This is so because no single element is required to resist stresses imposed thereon by another element bonded thereto, as may normally occur in laminated fabrics and assemblies.

While the foregoing discussion has been principally directed to a chair embodying the concept of the present invention, it must be appreciated that other structures and assemblies may benefit from the teachings herein. Accordingly, such uses are well contemplated within the present disclosure.

Thus, it should be evident that an electrostatic dissipative chair embodying the concept of the invention disclosed herein carries out the various objects of the invention and otherwise constitutes an advantageous contribution to the art.

I claim:

1. A seating device capable of dissipating an electrostatic charge received thereby, comprising:

a supportive substrate having an upper surface;

electrically conductive flexible mesh substantially enveloping said upper surface of said supportive substrate, said conductive mesh being suitable for receiving an electrostatic charge;

separate electrically nonconductive cover means substantially entirely contiguous to said electrically conductive means, said cover means being physically independent from said conductive mesh; and, means for electrically communicating said conductive mesh with an electrical ground;

wherein said supportive substrate presents a seating region, said conductive mesh being continuous throughout substantially the entire said seating region.

2. A seating device, according to claim 1, wherein said conductive mesh further comprises a weave of fine, nonconductive flexible strands and an electrically conductive coating carried on said flexible strands to define an electrically conductive medium.

3. A seating device, according to claim 2, wherein said cover means is an electrically nonconductive woven cover fabric.

4. A seating device, according to claim 3, wherein said conductive mesh has a surface resistivity of up to approximately $10^2$ ohms per square, and said cover fabric has a surface resistivity of at least approximately $10^{10}$ ohms per square.

5. A seating device, according to claim 4, wherein said conductive coating is a silver plating.

6. A seating device capable of dissipating an electrostatic charge received thereby, comprising:

frame means defining an electrical ground;

a rigid supportive substrate fixedly secured to said frame means;

cushion means carried by said supportive substrate;

electrically conductive flexible mesh substantially enveloping said cushion means, said mesh being physically independent from said cushion means and secured to said substrate about the periphery thereof;

separate electrically nonconductive cover means substantially entirely contiguous with said conductive mesh, but physically independent therefrom, and secured to said substrate; and means for electrically communicating said electrically conductive mesh with said frame means;

wherein said supportive substrate and said cushion means collectively present a seating region, said conductive mesh being continuous throughout substantially the entire said seating region.

7. A seating device, according to claim 6, wherein said conductive mesh comprises fine nonconductive flexible strands woven together to define an open weave and an electrically conductive coating carried on said flexible strands to define an electrically conductive medium, said strands being substantially continuous throughout said seating region.

8. A seating device, according to claim 7, wherein said cover means is an electrically nonconductive woven cover fabric.

9. A seating device, according to claim 8, wherein said conductive mesh has a surface resistivity of up to approximately $10^2$ ohms per square, and said cover fabric has a surface resistivity of at least approximately $10^{10}$ ohms per square.

10. A seating device, according to claim 9, wherein said conductive coating is a silver plating.

* * * * *